US010165817B2

(12) United States Patent
Redpath et al.

(10) Patent No.: US 10,165,817 B2
(45) Date of Patent: Jan. 1, 2019

(54) BATTERY PACK AND HELMET MOUNTING ARRANGEMENT

(75) Inventors: David Redpath, Beaconsfield (CA); Marie-Pierre Gendron, Mercier (CA); Stéphane Lebel, St. Redempteur (CA)

(73) Assignee: Revision Military S.a.r.l., Luxembourg (LU)

( * ) Notice: Subject to any disclaimer, the term of this patent is extended or adjusted under 35 U.S.C. 154(b) by 594 days.

(21) Appl. No.: 13/536,980

(22) Filed: Jun. 28, 2012

(65) Prior Publication Data

US 2014/0189938 A1 Jul. 10, 2014

(51) Int. Cl.

| | |
|---|---|
| ***A42B 1/24*** | (2006.01) |
| ***A42B 3/04*** | (2006.01) |
| ***F41H 1/04*** | (2006.01) |

(52) U.S. Cl.

CPC ..... *A42B 3/0406* (2013.01); *A42B 3/04* (2013.01); *F41H 1/04* (2013.01)

(58) Field of Classification Search

CPC ..... A42B 3/04; A42B 3/0453; A42B 3/0446; A42B 3/044; A42B 3/0433; A42B 3/0426; A42B 3/0406; F41H 1/04

USPC ..... 2/425, 182.2, 422, 2, 6.1, 6.2; 362/105–106

See application file for complete search history.

(56) References Cited

U.S. PATENT DOCUMENTS

| | | | | |
|---|---|---|---|---|
| 4,090,185 | A * | 5/1978 | Patty | 340/321 |
| 4,744,106 | A * | 5/1988 | Wang | 2/7 |
| 5,683,831 | A | 11/1997 | Baril et al. | |
| 6,122,773 | A * | 9/2000 | Katz | 2/171.3 |
| 7,017,055 | B1 * | 3/2006 | Ho | 713/300 |
| 7,921,473 | B1 * | 4/2011 | Winters | 2/171.3 |
| 8,117,676 | B1 * | 2/2012 | Cardoso | 2/410 |
| 2005/0174753 | A1 * | 8/2005 | Cao | A42B 3/044 362/106 |
| 2007/0247296 | A1 * | 10/2007 | Moore et al. | 340/467 |
| 2010/0095431 | A1 * | 4/2010 | Liao | A42B 1/244 2/209.13 |
| 2011/0210685 | A1 * | 9/2011 | Liao | 315/313 |
| 2012/0011631 | A1 | 1/2012 | Crossman et al. | |

* cited by examiner

*Primary Examiner* — Timothy K Trieu

(74) *Attorney, Agent, or Firm* — Wolf, Greenfield & Sacks, P.C.

(57) ABSTRACT

Methods and devices for attaching a battery to a helmet and attaching a battery to an additional device are disclosed. A battery may be mounted to the rear center of a helmet. Attaching and detaching a battery to and from a helmet may be performed with a tool or by hand. The battery may be used to power multiple devices through separate contacts, and a device may be attached to the battery while the battery mounted to a helmet. The battery also may be detached from the helmet and serve as a portable energy source.

14 Claims, 13 Drawing Sheets

BATTERY PACK AND HELMET MOUNTING ARRANGEMENT

FEDERALLY SPONSORED RESEARCH

This invention was made with government support under W911QY11C0046 awarded by the Department of Defense. The government has certain rights in the invention.

FIELD

Aspects herein relate to mounting arrangements and methods for mounting a battery pack to a helmet. Methods and apparatuses for attaching devices to a helmet-mounted battery are also described herein.

DISCUSSION OF RELATED ART

Many helmets require battery assemblies to power electronic devices which are attached or integral to the helmet.

SUMMARY

According to one embodiment of the invention, a helmet system includes a helmet, a battery pack including at least one battery, and a first engaging member to attach the battery pack to the helmet. The helmet also includes a first electrical contact to deliver power from the battery pack to a first device associated with the helmet when the battery pack is attached to the helmet. The helmet also includes a second electrical contact spaced from the first electrical contact. The second electrical contact is configured to deliver power from the battery pack to a second device when the second device is electrically connected to the battery pack.

According to another embodiment of the invention, a helmet system includes a helmet, a battery pack including least one battery, and a first engaging member to attach the battery pack to the helmet. The helmet also includes a first electrical contact to deliver power from the battery pack to a first device associated with the helmet when the battery pack is attached to the helmet. The helmet also includes a second engaging member to attach a second device to the battery pack. The helmet also includes a second electrical contact spaced from the first electrical contact and located on the battery pack. The second electrical contact is configured to deliver power from the battery pack to the second device when the second device is attached to the battery pack.

According to a further embodiment of the invention, a helmet system includes a helmet, a battery pack including at least one battery, and a first attachment arrangement to removably attach the battery pack to the helmet. The first attachment arrangement includes a locking member and an engaging member to engage with the locking member. The engaging member is configured to receive the locking member when the locking member is in a first configuration. When the locking member is engaged with the engaging member and in a second configuration, the locking member locks the battery pack to the helmet. Attachment of the battery pack to the helmet via the first attachment arrangement electrically connects the battery pack to an electrical contact associated with the helmet.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. Various embodiments of the invention will now be described, by way of example, with reference to the accompanying drawings, in which.

DETAILED DESCRIPTION

Helmets for head protection and safety are often used in conjunction with electronic devices that require power from an energy source. For example, construction hardhats and mining helmets may include attached headlamps and/or communication devices. Helmets for law enforcement and military personnel may be used with various electronic devices such as a Night Vision Device (NVD), an identification friend or foe system (IFF), a helmet-mounted display unit and/or other suitable electronic devices.

Applicants have recognized that in some conventional helmet-mounted battery arrangements where the battery is positioned on the top surface of the helmet or on the side of the helmet, the battery weight may apply torque to the user and/or create moment of inertia stresses on the helmet. Embodiments disclosed herein include helmet-mounted battery arrangements in which a battery is positioned and arranged on a helmet in a manner which reduces torque on the user and/or moment of inertia stresses on the helmet.

Applicants have also recognized that certain conventional arrangements require a significant amount of time to attach and detach the battery to and from the helmet, and certain conventional arrangements do not provide a secure attachment between the battery and the helmet. Embodiments herein provide a helmet-mounted battery arrangement that enables a secure attachment between the battery and the helmet while permitting a user to quickly attach and detach the battery.

In addition, the inventors have recognized that helmets may be used in conjunction with multiple electronic devices that require power, while also recognizing that multiple battery devices may be cumbersome to the wearer due to increased weight and bulkiness. Embodiments herein provide a helmet-mounted battery arrangement in which a single battery can be used to power multiple electronic devices.

The term, "battery" as used herein is defined to include any battery type, such as, for example, rechargeable, non-rechargeable, alkaline, aluminum, lithium, lithium-ion, lithium ion polymer, nickel-cadmium, nickel-iron, nickel metal hydride, etc. The term "battery pack" as used herein is intended to include a housing or a casing or a support or one or more batteries. A battery pack may include electrical contacts that permit the battery to transmit power to other devices, whether directly or via a power bus.

Figure 1:
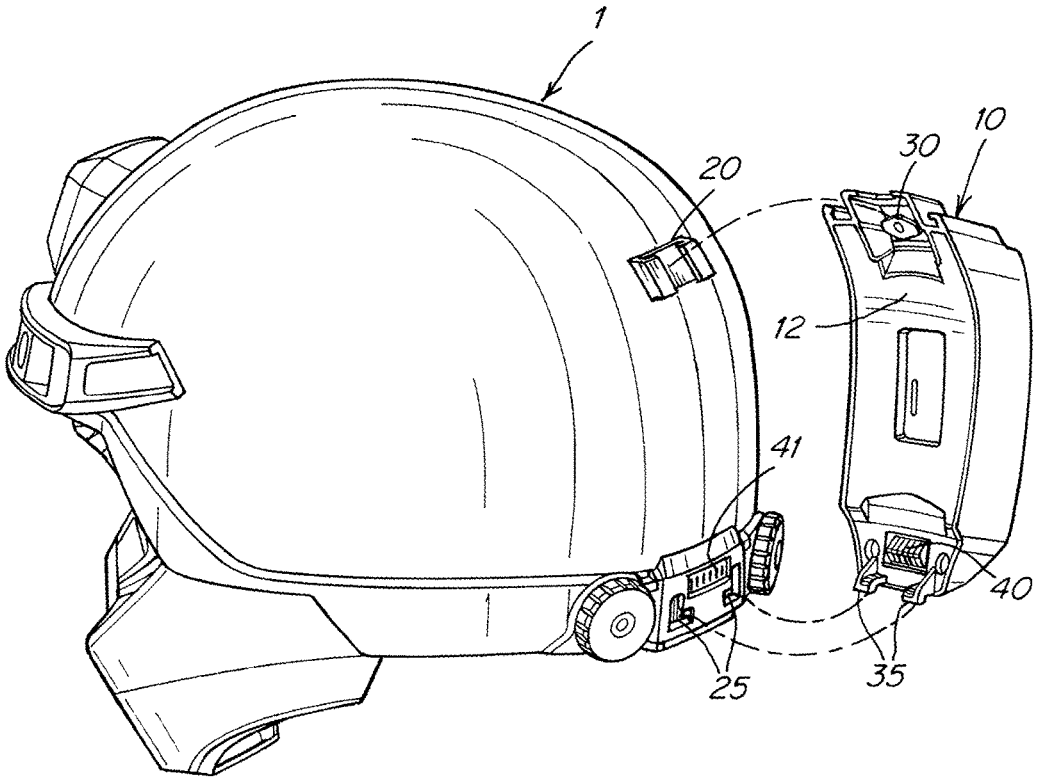
FIG. 1 is a perspective view that depicts an arrangement for mounting a battery to a helmet in accordance with an aspect of the invention.
Figure 2:
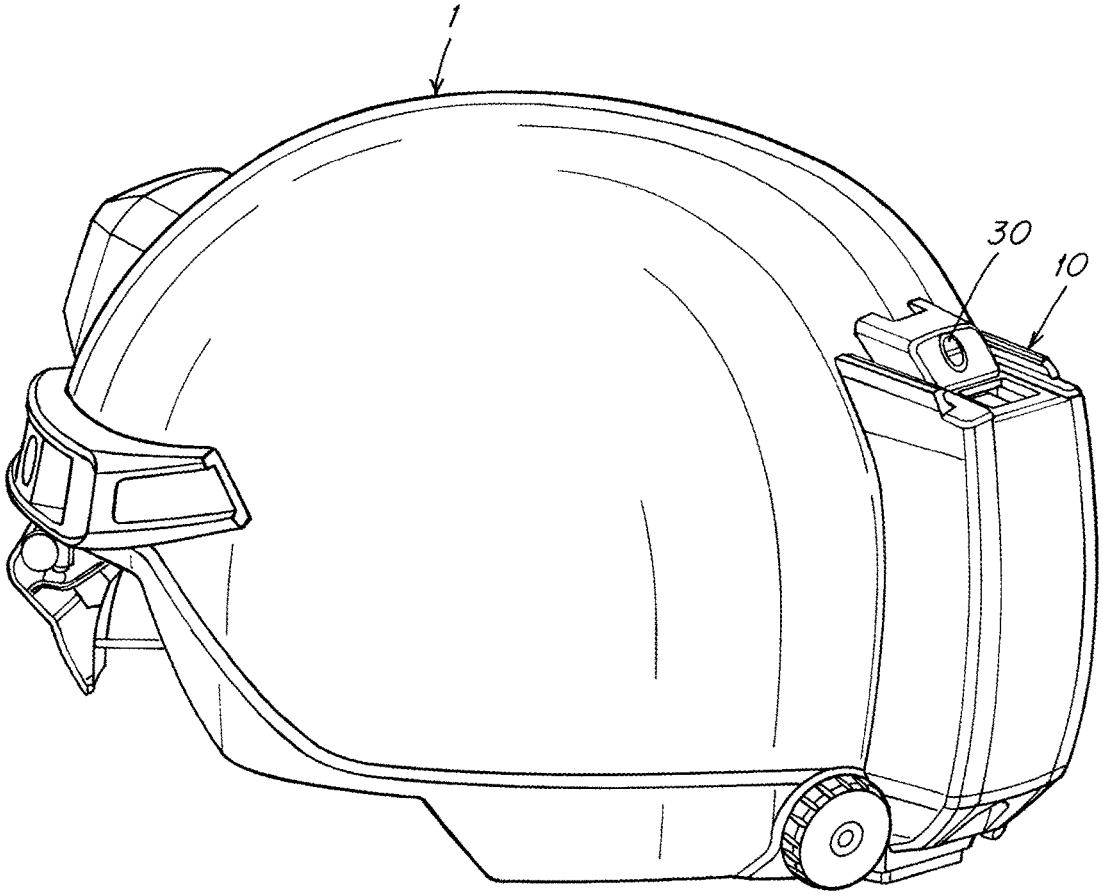
FIG. 2 is a perspective view that depicts the arrangement shown in FIG. 1 with the battery mounted to the helmet.

According to one aspect of the invention, a battery may be positioned and mounted on a helmet in an arrangement that reduces moment of inertia stresses on the helmet. As shown in FIGS. 1 and 2, in one embodiment, a battery 10 may be positioned at the center of the rear of a helmet 1. In certain conventional helmets, the weight of devices that are attached to the front of the helmet may be balanced by adding a counterweight to the rear of the helmet, thereby increasing the total weight to the user's head. According to one aspect, a battery positioned at the rear of the helmet may serve as a counterweight to devices attached to the front of the helmet, thereby eliminating the need to add an additional counterweight to the helmet to balance front-mounted devices. As such, the battery may serve a dual purpose of supplying energy and providing counterbalance. In some embodiments, battery 10 may be curved or otherwise shaped to conform to the contour of the helmet. In the embodiments, as shown in FIGS. 1-7 and 9-11, battery 10 attaches to the helmet in a vertical orientation and is substantially curved along a vertical direction to conform to the shape of the helmet. A conformal battery profile may help to reduce bulkiness, limit torque on the user, and lower the risk of snags by decreasing the number of exposed edges and corners that may become caught on wires, ropes, branches, etc.

According to another aspect of the invention, a battery may be mountable to a helmet in a configuration that enables a secure attachment between the battery and the helmet while permitting a user to quickly attach and detach the battery. In one embodiment, shown in FIGS. 3-6, a battery mounting system may include two attachment arrangements. According to one aspect, one attachment arrangement may provide an initial support for the battery that provisionally couples the battery to the helmet, while the other attachment arrangement may secure the battery to the helmet in a locked engagement. In some cases, attaching the battery to the helmet is a multi-step process: one attachment arrangement is operated to provisionally couple the battery to the helmet, then the battery is pivoted toward the helmet, and finally a second attachment arrangement is operated to lock the battery to the helmet.

Figure 3A:
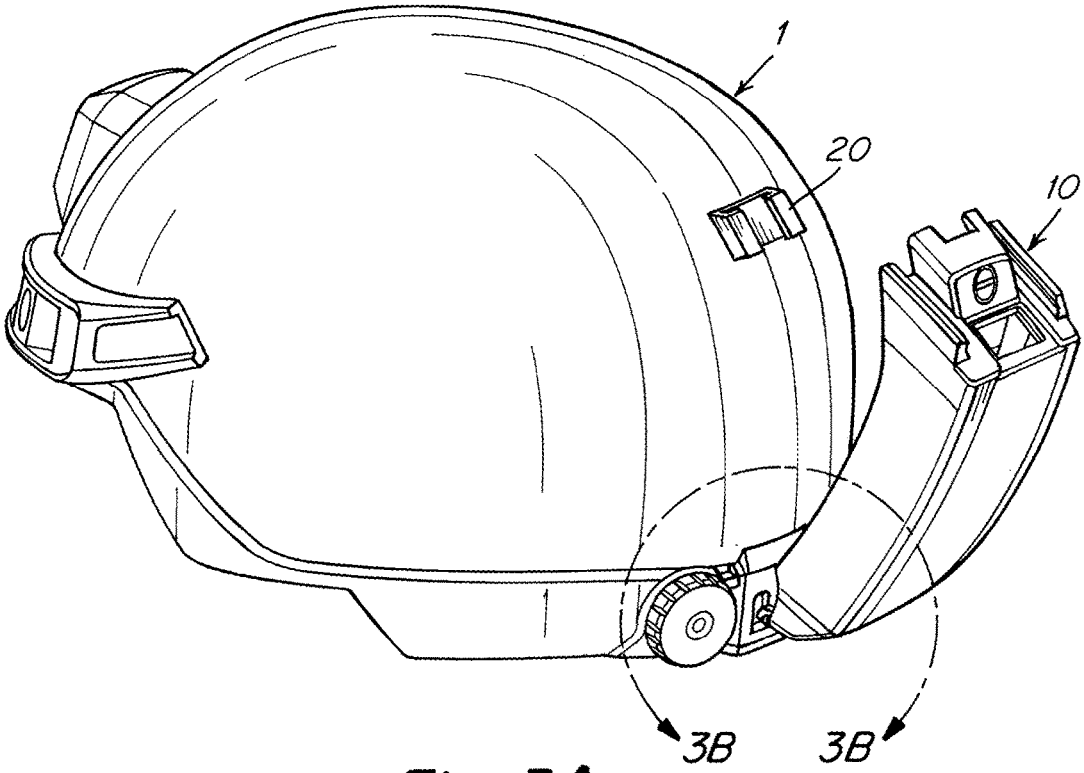
FIG. 3A is a perspective view that illustrates a step in mounting a battery to a helmet.
Figure 3B:
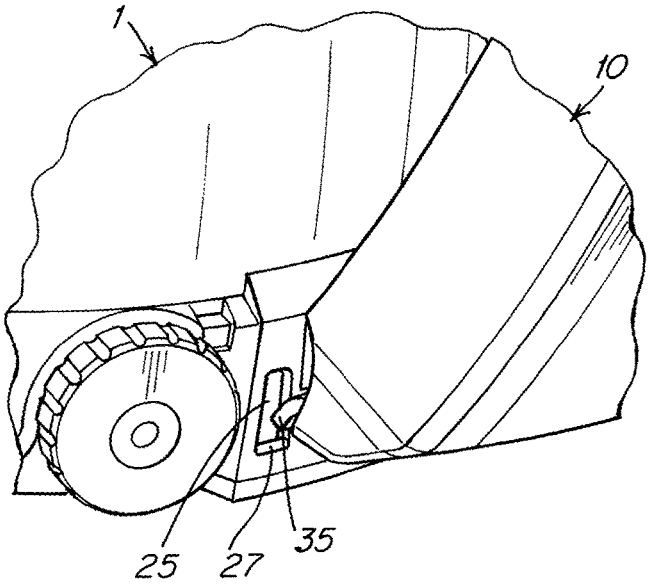
FIG. 3B is a perspective view that depicts the enlarged portion of FIG. 3A seen encircled by arrow 3B-3B.

In one embodiment, as shown in FIGS. 3A-B, a first attachment arrangement may include tabs 35 attached to a bottom of battery 10 and slots 25 in helmet 1. To attach battery 10 to helmet 1, according to one embodiment, a user first inserts the tabs 35 of battery 10 into the slots 25 of helmet 1. As the tabs 35 of the battery rest on a slot ledge 27 (see FIG. 3B) of the slots 25, the slots 25 serve as an initial support for the battery 10, thereby provisionally coupling the helmet 1 and battery 10 together. In some cases, this provisional coupling may not securely attach the battery 10 to the helmet 1. For example, if the user were to insert the tabs 35 into the slots 25 and let go of the battery 10 without securing the top of the battery 10 to the helmet 1, the battery 10 may tilt away from the helmet 1 due to gravity and tabs 35 may fall out of slots 25, causing the battery 10 to fall away from the helmet 1.

It should be appreciated that the engagement between slots 25 and tabs 35 may provide a secure attachment rather than a provisional coupling. For example, if slots 25 and tabs 35 are sized to engage in an interference fit, or if an additional latch or screw is used in cooperation with the slots 25 and tabs 35.

It should also be appreciated that the first attachment arrangement is not limited to the tabs 35 and slots 25 shown in the figures. Alternatively or in addition, the first attachment arrangement may comprise any suitable attachment configuration, such as a tongue and groove joint or other sliding mount, an interference fit, a latch-type attachment, a threaded connection, a luer lock fitting, a quick connect fitting, or other suitable attachment configuration.

In some embodiments, the first attachment arrangement serves to restrict the battery from vertical movement relative to the helmet. In other embodiments, the first attachment arrangement serves to restrict the battery from any movement relative to the helmet. In yet other embodiments, the first attachment arrangement does not restrict movement of the battery at all.

Figure 4:
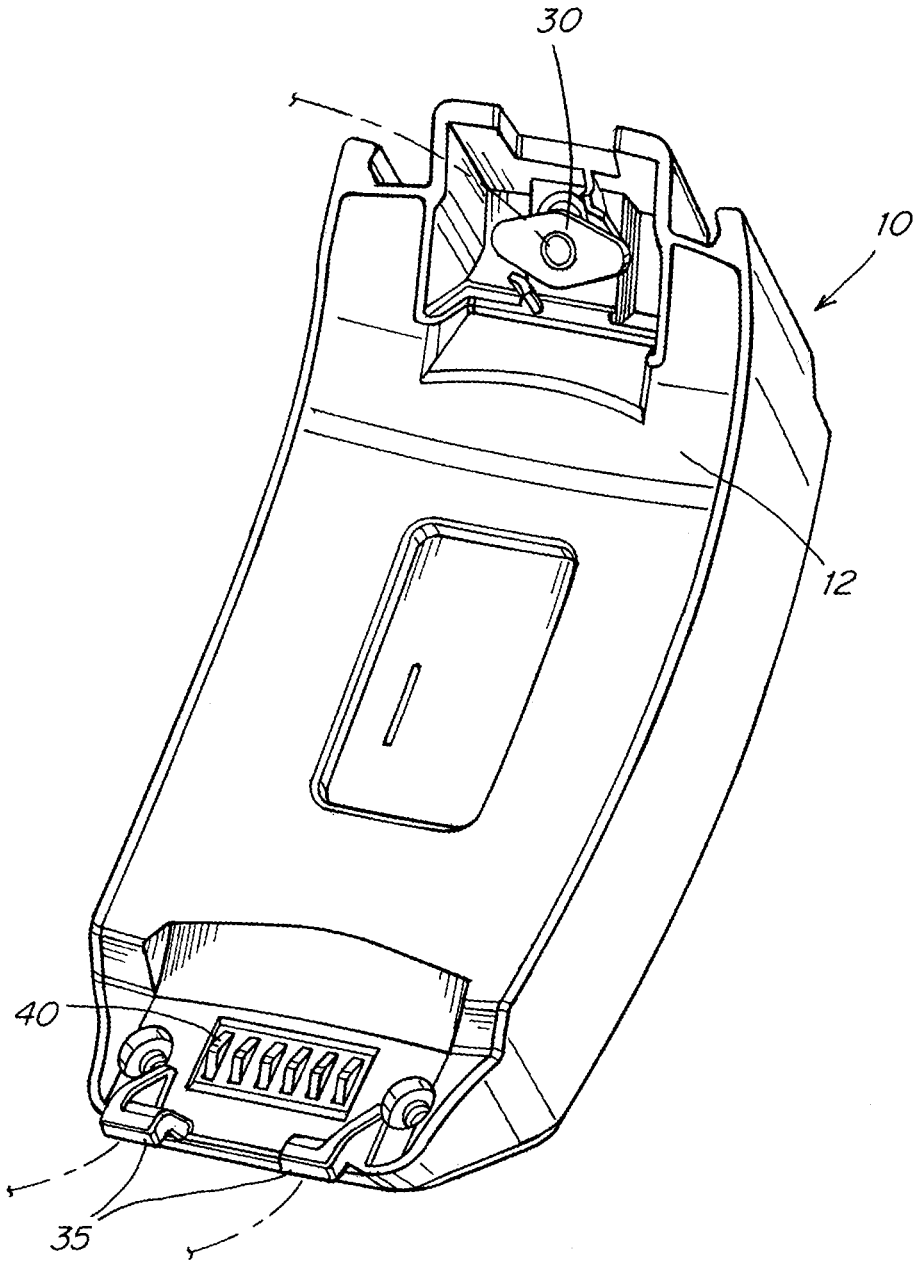
FIG. 4 is a perspective view of the back of the battery shown in FIG. 1.
Figure 5:
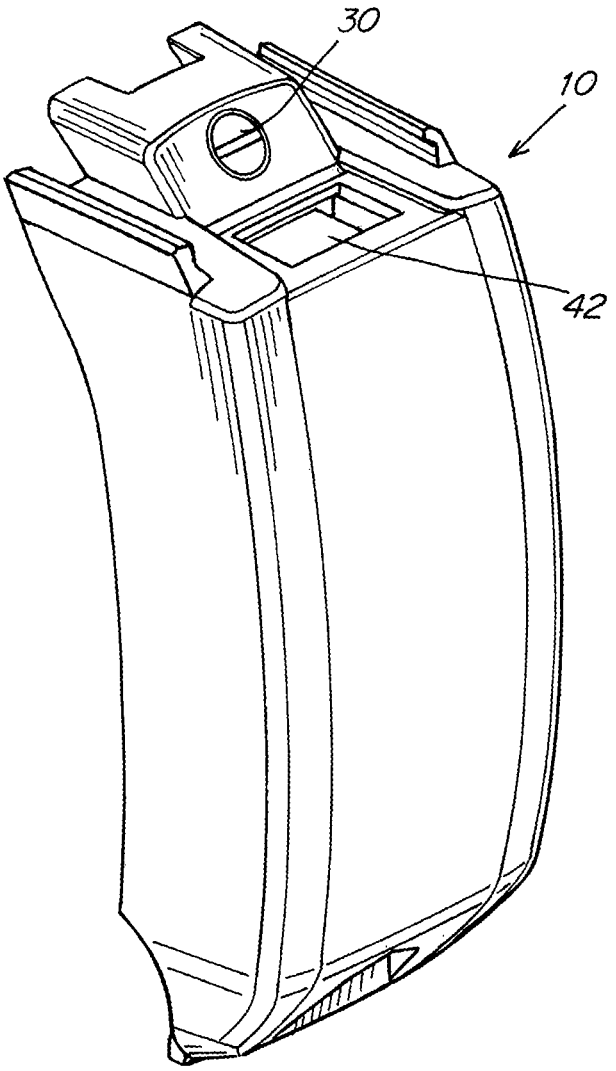
FIG. 5 is a perspective view of the front of the battery shown in FIG. 1.
Figure 6:
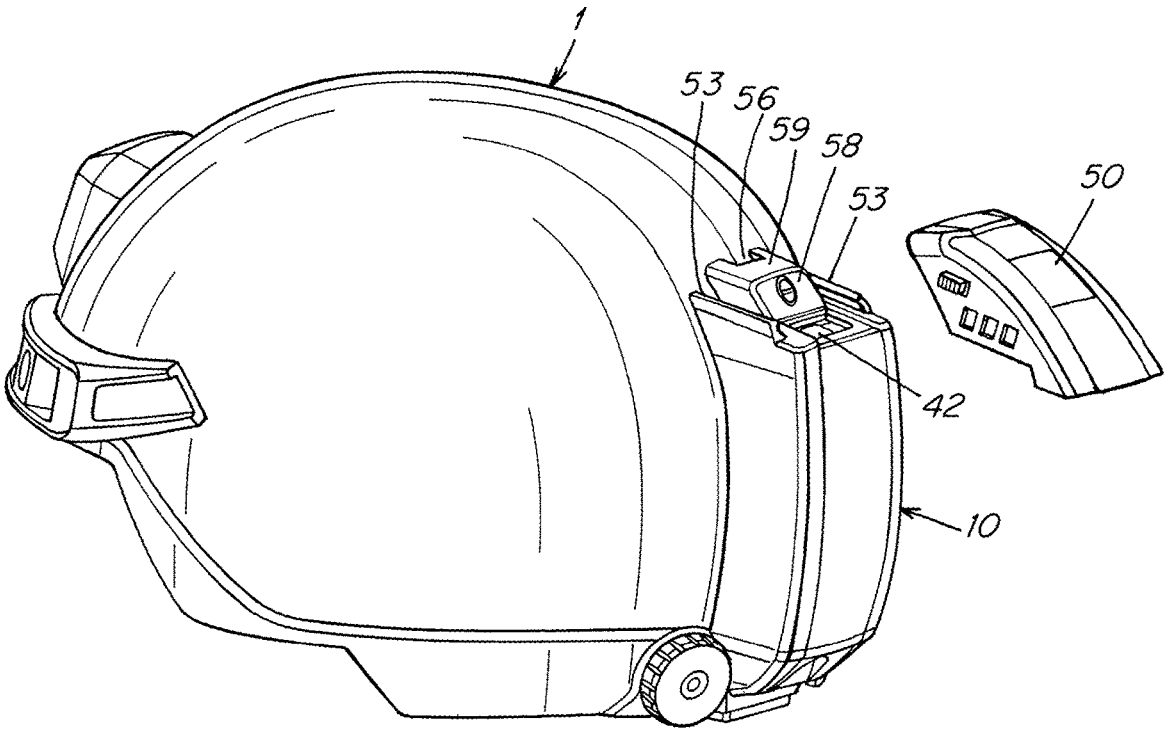
FIG. 6 is a perspective view that depicts an arrangement for mounting a device to a helmet-mounted battery in accordance with another aspect of the invention.

In one embodiment, after the tabs 35 are received within the slots 25 or the first attachment arrangement is otherwise actuated, the user may pivot the battery 10 up toward helmet 1 until the rear surface 12 of the battery 10 contacts the helmet 1. As shown in FIGS. 1 and 4-5, a second attachment arrangement may include a locking member 30 attached to battery 10 and an engaging member 20 attached to helmet 1. Holding the battery 10 against the helmet 1, the user actuates locking member 30, thereby locking the battery to the helmet. To actuate locking member 30, a user may twist, push, press, pull, rotate, spin, lift, lower, pivot, or apply any suitable force directly or indirectly to locking member 30. Locking member 30 may also be actuated via an electronic signal or by depression of a button.

It should be appreciated that the second attachment arrangement is not limited to the engaging member 20 and locking member 30 shown in the figures. In some embodiments, the locking member 30 may include a hand-operable protruding knob such that a user can grasp and turn the knob by hand in order to rotate locking member 30. Alternatively or in addition, the engaging member 20 on the helmet 1 may include a latch that engages with locking member 30 on the battery 10, or the locking member 30 may include a latch that engages with the engaging member 20. In some embodiments, the locking member 30 may include a recess configured to receive a tool, such as a Phillips head screwdriver, a flat-head screwdriver, a hex screw driver, or other suitable tool, as this aspect is not limited in this regard. The recess also may be configured to receive objects such as coins, paper clips, pen clips, knives, flat rocks, or sticks, as this aspect is not limited in this regard. In some cases, the recess also may be configured to receive a user's finger or fingernail. Alternatively or in addition, the second attachment arrangement may comprise any suitable attachment configuration, such as a sliding mount, an interference fit, a latch-type attachment, a threaded connection, a luer lock fitting, a quick connect fitting, or other suitable attachment configuration, as this aspect is not limited in this regard.

In some embodiments, actuation of the second attachment arrangement restricts the battery from vertical movement relative to the helmet. In other embodiments, actuation of the second attachment arrangement restricts the battery from any movement relative to the helmet. In yet other embodiments, actuation of the second attachment arrangement does not restrict movement of the battery at all. In yet other embodiments, the first configuration serves to restrict vertical movement of the battery relative to the helmet while the second configuration serves to restrict horizontal movement of the battery relative to the helmet, or vice versa.

The positions of the two attachment arrangements along the battery and helmet may vary. For example, in some embodiments, a locking member and an engaging member are positioned toward the bottom end of the battery and helmet while tabs and slots are positioned toward the top end of the battery and helmet. In such embodiments, the user inserts the tabs of the battery into the slots of the helmet and pivots the battery down toward the helmet until the rear surface 12 of the battery contacts the helmet. In some embodiments, only one attachment arrangement is used instead of two.

In some situations, various devices, such as an identification friend or foe system (IFF), may be used only occasionally or even rarely. Many conventional IFFs require a significant amount of power and are often powered by a large, heavy battery which is dedicated to the IFF. According to another aspect of the invention, a single battery may be arranged to power multiple electronic devices. In some cases, using a single battery to power multiple devices may reduce or eliminate the need for multiple batteries that add weight and bulkiness.

The battery may power the electronic devices simultaneously or alternate between the devices. The battery may provide the same voltage to each device, or may have the ability to detect and determine the appropriate voltage to use for each device and adjust its voltage output accordingly. The battery may have multiple electrical contacts, where each contact is configured to supply electricity to a different electronic device.

In one embodiment, as shown in FIG. 1, battery 10 has a first electrical contact 40 that contacts electrical contact 41 on helmet 1 when battery 10 is attached to helmet 1. Electrical contact 41 may deliver power to various electronic devices associated with the helmet via any suitable connector such as a power bus. Any suitable power bus such as a flexible printed circuit board may be used, including embodiments disclosed in an application entitled, "Helmet Configured for Electronics" filed on even date herewith, which is incorporated herein by reference in its entirety.

It should be appreciated that first electrical contact 40 need not directly contact electrical contact 41. For example, a cable or other conductive connector may connect first electrical contact 40 to electrical contact 41 or to any other helmet system. Other suitable arrangements may exist, as this aspect is not limited in this regard. First electrical contact 40 may supply energy to power helmet systems such as a Night Vision Device (NVD), a headlamp, an identification friend or foe system (IFF), a helmet-mounted display unit, a communication device such as a cell phone or other portable transceiver, or other suitable electronic device, as this aspect is not limited in this regard. Any suitable helmet-mounted display unit may receive power from first electrical contact 40, including embodiments disclosed in an application entitled, "Helmet-Mounted Display" filed on even date herewith, which is incorporated herein by reference in its entirety.

Turning to FIGS. 6-9, battery 10 may have a second electrical contact 42 that supplies energy to a second device 50. Second electrical contact 42 may supply power to device 50 by directly contacting an electrical contact 43 of device 50 via a cable or other conductive connector that connects second electrical contact 42 to device 50, or by any other suitable arrangement. In some embodiments, device 50 may be a device that is used occasionally, such as an IFF, headlamp, or flashlight. However, it should be appreciated that this aspect is not limited in this respect, and as such, device 50 could be any device, regardless of frequency of use.

Figure 7:
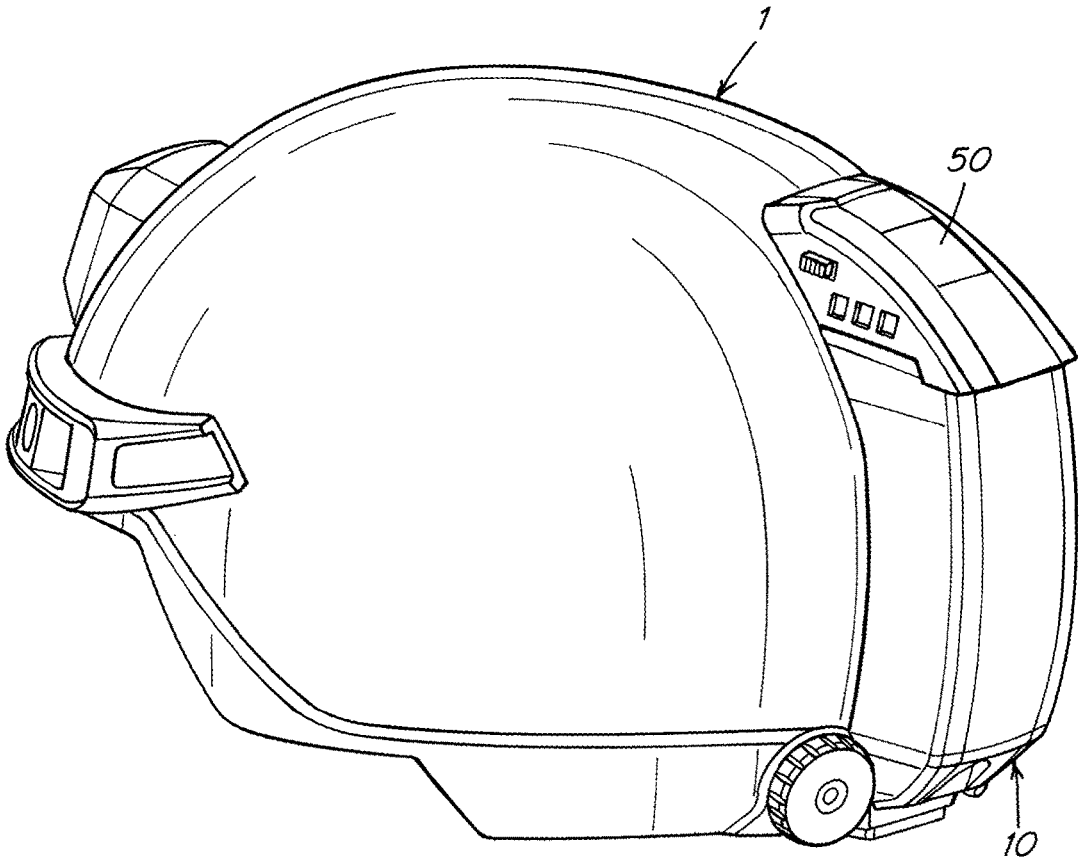
FIG. 7 is a perspective view that depicts the arrangement shown in FIG. 6 with the device mounted to the helmet-mounted battery.

According to another aspect of the invention, a helmet-mounted battery may be attached to a helmet while simultaneously supporting a device. In one embodiment, as shown in FIGS. 6-11, a device 50 may be mounted to the top of battery 10. Of course, it should be appreciated that device 50 or any other object may be mounted at any location on the battery, as this aspect is not limited in this regard. Battery 10 may be mounted on any portion of the battery such as the top, bottom, sides, edges, corners, rear, or front of the battery. As shown in FIG. 7, device 50 may conform to the contour of the helmet 1 and match the profile, width, and thickness of battery 10. A device 50 that conforms to helmet 1 and to the profile of battery 10 may help to reduce bulkiness and lower the risk of snags by reducing the number of exposed edges and corners that may become caught on wires, ropes, branches, etc. Such an arrangement also may help to save space by utilizing the available space above battery 10. In some embodiments, device 50 may be an electrically powered container or cooler for keeping items such as ice, medicine or food cold. While device 50 may be an electronic device that is powered by battery 10, it should be appreciated that device 50 may be a non-electrical object, as this aspect is not limited in this regard. In addition, device 50 may be an electronic device that does not receive power from battery 10.

Figure 8:
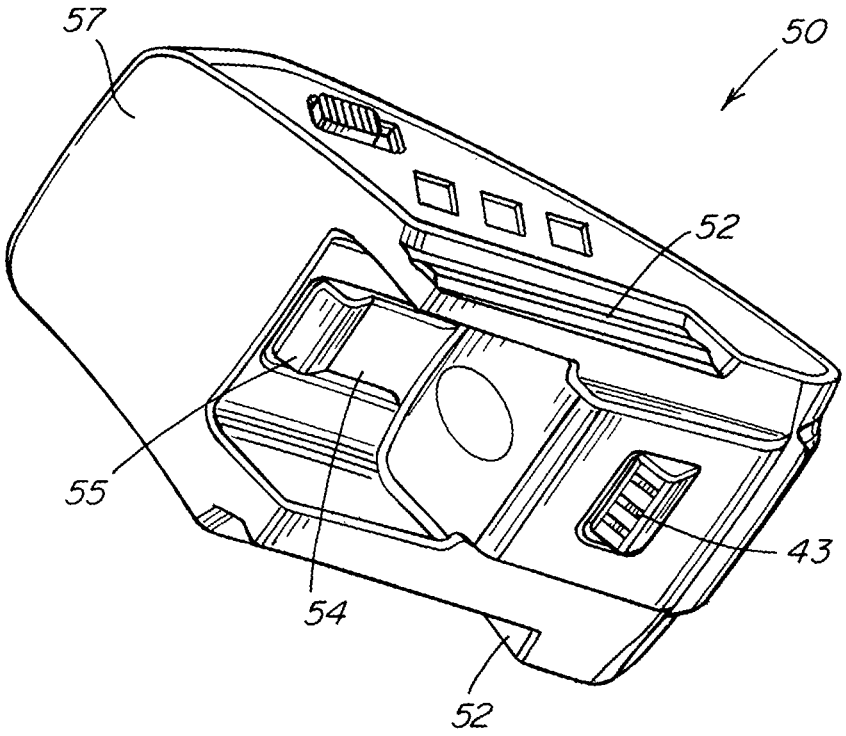
FIG. 8 is a perspective view that depicts the underside of the device shown in FIG. 6.
Figure 9:
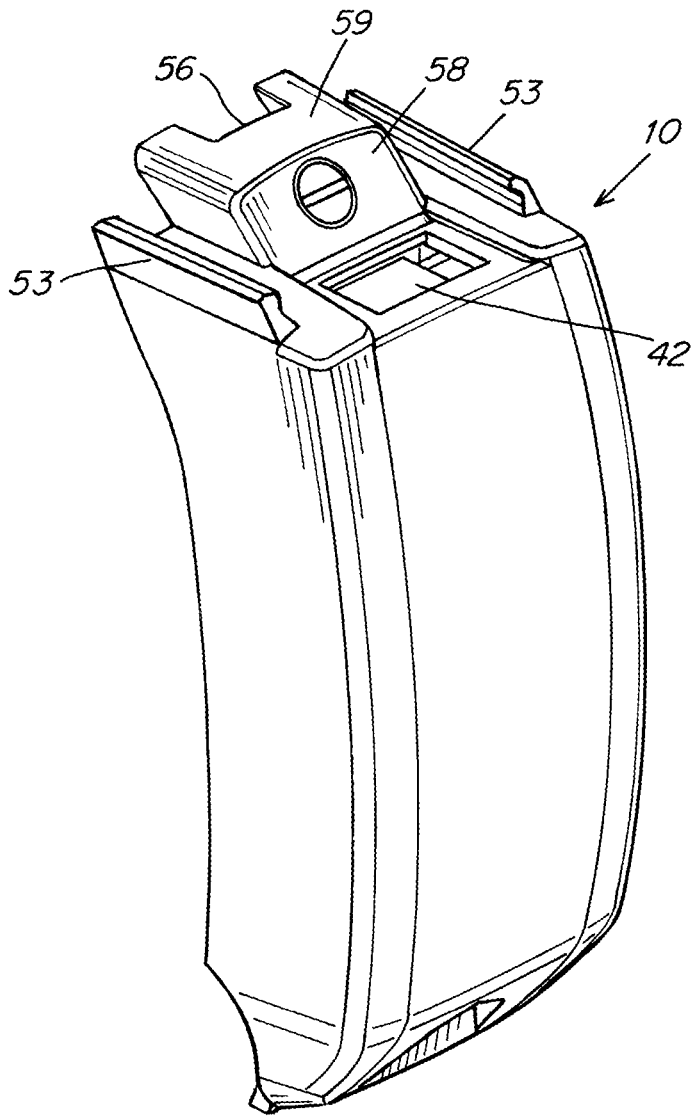
FIG. 9 is a perspective view of the front of the battery shown in FIG. 6.
Figure 10:
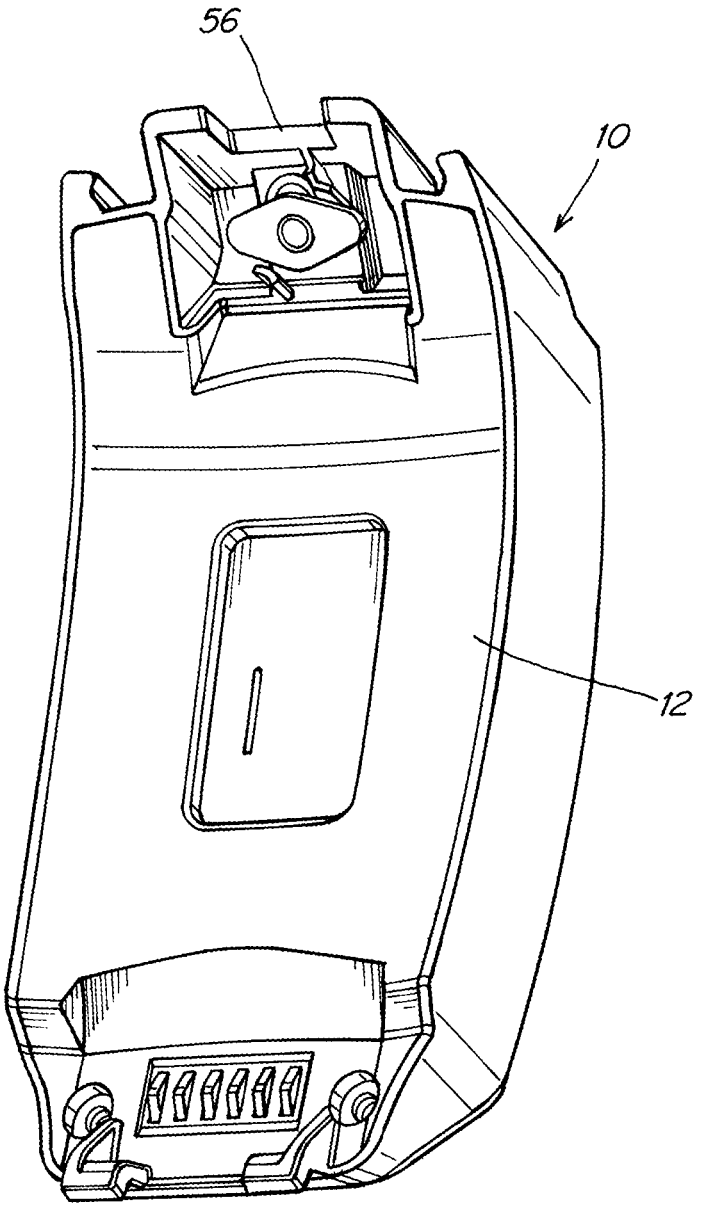
FIG. 10 is a perspective view of the back of the battery shown in FIG. 6.

In some embodiments, to attach device 50 to battery 10, a user slides the base of device 50 onto the top of battery 10 toward the helmet 1. As shown in FIGS. 8 and 9, grooves 52 on device 50 may interact with rails 53 on battery 10 to permit device 50 to slidably engage with battery 10. In some embodiments, the battery 10 and device 50 may be attached using a friction fit or push-fit engagement. As device 50 slides onto battery 10 towards helmet 1, top surface 59 of battery 10 may contact protrusion 55 of tab 54 on the underside of device 50, causing tab 54 to deflect upward in a stressed state. When the rear face 57 of device 50 approaches the front surface 58 of battery 10, protrusion 55 may be received into slot 56 on the back of battery 10 (see FIGS. 9-10), permitting tab 54 to snap back downward to its unstressed orientation. Receipt of protrusion 55 into slot 56 locks the device 50 into place, and secures device 50 to battery 10. When tab 54 snaps down from its stressed deflection state to its unstressed orientation, the tab 54 claps onto top surface 59 and produces an audible sound such as a click, clap or snap that informs the user that device 50 is securely attached to battery 10. Alternatively or in addition, engagement of protrusion 55 with slot 56 may produce an audible sound such as a click, clap or snap that indicates attachment.

To detach device 50 from battery 10, a user pulls on device 50 in a direction away from helmet 1, causing the edge of slot 56 to push upward against protrusion 55, thereby causing tab 54 to deflect upwards. Upward deflection of tab 54 and protrusion 55 releases the engagement between slot 56 and protrusion 55, allowing the user to freely slide device 50 off of the battery 10.

Of course, it should be appreciated that other configurations are possible. For example, device 50 may rest on battery 10 but engage and attach to helmet 1, or device 50 may engage and attach to both the helmet 1 and battery 10. Device 50 may attach to battery 10 and/or helmet 1 via any suitable attachment configuration, such as a sliding mount, an interference fit, a latch-type attachment, a threaded connection, a luer lock fitting, a quick connect fitting, or other suitable attachment configuration, as this aspect is not limited in this regard.

Figure 11:
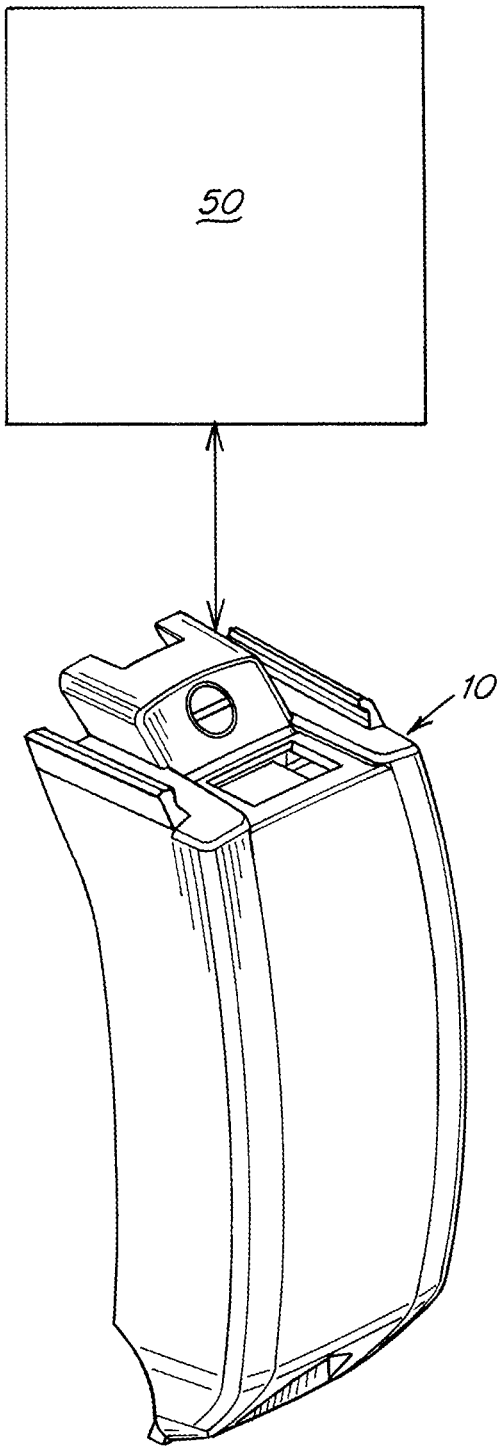
FIG. 11 is a perspective view of a battery cooperating with a device.

According to another aspect of the invention, a helmet-mountable battery may be detached from a helmet and used as a portable energy source. In one embodiment, as shown in FIG. 11, battery 10 is detached from a helmet and freely portable. Battery 10 may be configured to power a device 50, thus serving as a portable energy source. For example, device 50 may be a flashlight, a transceiver or other communication device, a portable media player, a personal digital assistant, a calculator, a handheld console, a computer or other device with a microprocessor, powered binoculars, or other suitable device, as this aspect is not limited in this regard. Battery 10 may be used as a primary or back-up energy source. Alternatively or in addition, device 50 may attach to battery 10 using the attachment configuration described previously in FIGS. 6-10, or via any suitable arrangement such as a sliding mount, an interference fit, a latch-type attachment, a threaded connection, a latch-type attachment, a luer lock fitting, a quick connect fitting, or other suitable attachment configuration, as this aspect is not limited in this regard.

According to one aspect, attachment between the battery 10 and helmet 1 and/or between the battery and device 50 may be accomplished using an attachment arrangement that enables tool-free connection or removal. For example, embodiments of the attachment arrangement between a helmet and earpiece disclosed in U.S. patent application Ser. No. 13/359,800, entitled, "Helmet Earpiece", which is incorporated herein by reference in its entirety, may be adapted to be an attachment arrangement between a helmet and a battery and/or between a second device and a battery.

Figure 12:
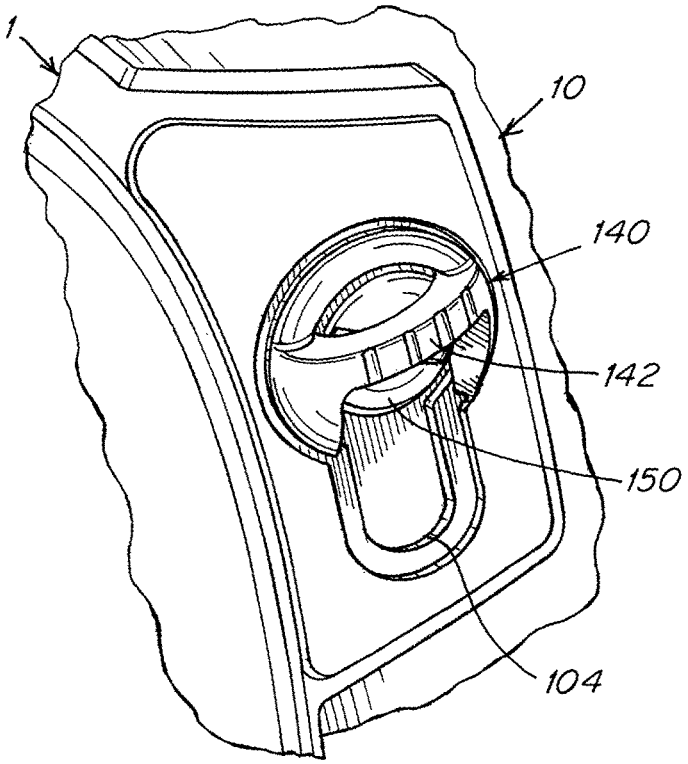
FIG. 12 is a perspective view that depicts an embodiment of an attachment arrangement in an unlocked position.
Figure 13:
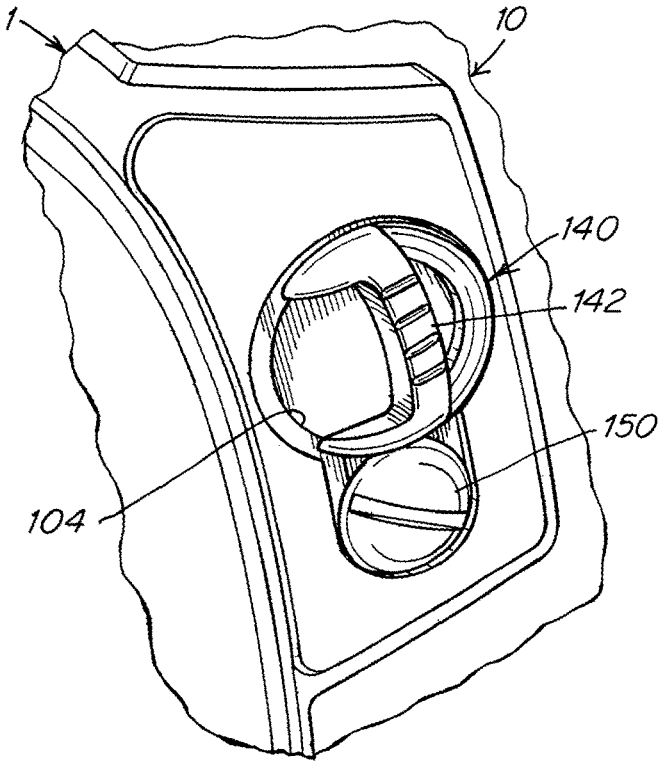
FIG. 13 is a perspective view that depicts the attachment arrangement shown in FIG. 12 in a locked position.

FIGS. 12-14 illustrate one embodiment of an attachment arrangement between a battery 10 and a helmet 1. However, it should be appreciated that such an arrangement may be adapted to attach a device such as device 50 in FIGS. 6-11 to the battery 10. In one illustrative embodiment, the attachment arrangement includes a lock that is rotatable between the unlocked and locked positions. For example, FIG. 12 illustrates one embodiment of battery 10 mounted to the helmet 1 with a lock 140 in an unlocked position, and FIG. 13 shows lock 140 in a locked position. Lock 140 may rotate between the locked and unlocked position. In some embodiments, the lock 140 may linearly slide to move between the unlocked and locked positions. Further, in some embodiments the lock may slide and rotate to move between the unlocked and locked positions.

Figure 14A:
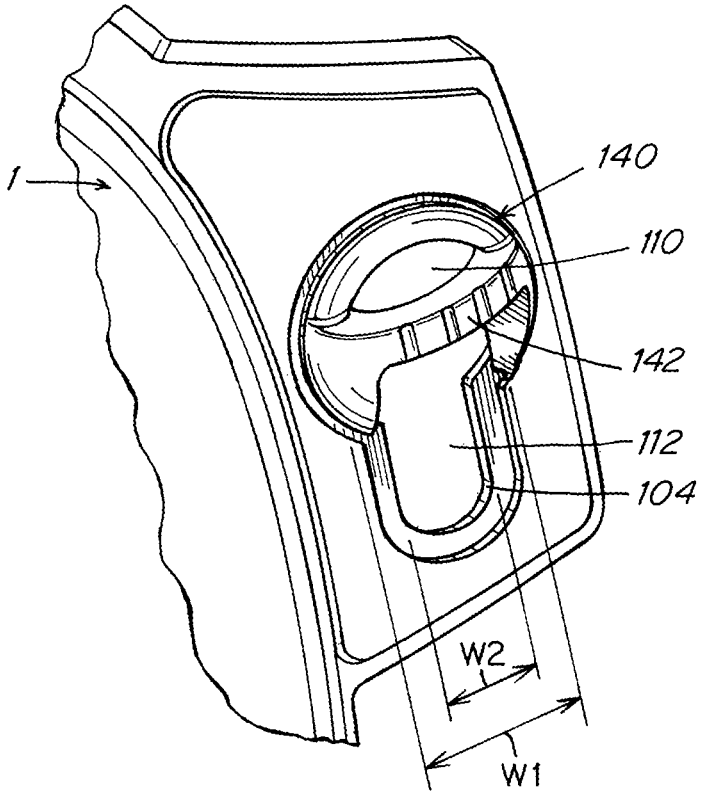
FIG. 14A is a perspective view that depicts the opening and lock shown in FIG. 12.
Figure 14B:
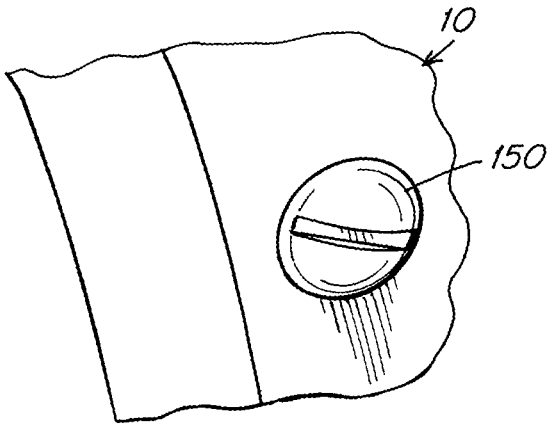
FIG. 14B is a perspective view that depicts the battery projection shown in FIG. 13.

Turning to FIGS. 14A-B, the battery 10 may be mounted to the helmet 1 by moving the battery 10 to the helmet 1 and aligning the opening 104 in the helmet 1 with the battery projection 150 such that the battery projection 150 extends into the opening 104. The lock 140 is moved from the unlocked position into the locked position to prevent the battery projection 150 from separating from the opening 104. The lock 140 may include an outwardly extending grip 142 which may be grasped to move the lock. As shown, the grip 142 may include a fluted edge for the wearer to grasp.

As shown in the embodiment illustrated in FIG. 14A, the opening 104 on helmet 1 may be configured as a slot which includes a first portion 110 sized to receive the battery projection 150 on battery 1 when the lock is in the unlocked position. The slot may also include a second portion 112 sized to retain the battery projection 150 when the lock 140 is in the locked position. As illustrated, the first portion 110 of the slot may be located at one end of the opening 104 and the second portion 112 of the slot may be located at the opposite end of the opening 104. As shown in FIG. 14A, the first portion 110 may have a width W1 and the second portion 112 may have a second width W2, where the width W1 of the first portion 110 may be larger than the W2 of the second portion 112.

The width W1 of the first portion 110 of the slot may be greater than a corresponding width of the battery projection 150 such the battery projection 150 fits into the slot. The width W2 of the second portion 112 of the slot may be less than a corresponding width of the battery projection 150. For example, in one illustrative embodiment, the battery projection 150 is a bolt and the width of the bolt head is less than the width W1 of the first portion 110 but greater than the width W2 of the second portion 112. In this respect, the battery projection 150 may not be able to slide out of second portion 112 of the slot.

The wearer may attach the battery 10 to the helmet 1 by using one hand to mount the battery 10 to the helmet 1 such that the battery projection 150 (such as a bolt head) extends into the opening 104 in the body of the helmet 1. After the projection is seated in the opening 104, the wearer may use one hand to reposition the projection 150 from the first portion 110 within the opening 104 into the second portion 112 within the opening 104. The wearer may grasp the grip 142 to move the lock 140 on the helmet 1 from the unlocked position into the locked position to lock the projection 150 in the opening.

When the lock 140 is moved into the locked position, the lock 140 retains the battery projection 150 in the slot. The lock 140 may prevent the battery projection 150 from moving out of the second portion 112 of the slot and back into the first portion 110 of the slot. In one illustrative embodiment, a portion of the lock 140 obstructs the slot and prevents movement of the battery projection 150. A portion of the lock 140 may contact the battery projection 150 to prevent movement of the battery projection.

The lock 140 may be configured in a variety of ways, as this aspect is not necessarily so limited. In one illustrative embodiment, the lock 140 has a substantially C-shaped body. The arms of the substantially C-shaped body may define an opening, and as shown in FIG. 14A, when in the unlocked position, the arms of the substantially C-shaped lock body may be positioned along a perimeter of the opening 104 such that the lock 140 does not interfere with the passage between the first and second portions 110, 112 of the opening 104. When in the locked position, the arms of the substantially C-shaped body may move into the opening 104 and may obstruct the region between first and second portions 110, 112 of the opening 104.

The above described components may be made with various materials, as the invention is not necessarily so limited. The helmet and battery housing, may for example, be made of various plastic and/or metal layers. In one embodiment, the battery housing and/or helmet may be made from an ultra-high molecular weight polyethylene known as Dyneema®, which may be obtained from DSM Dyneema LLC. In one embodiment, the battery housing and/or helmet may be made from a synthetic fiber known as Kevlar, which may be obtained from DuPont. In one embodiment, the battery housing and/or helmet may be made from carbon fibers. The battery housing and the helmet may be made from materials designed to withstand various ballistic, compression and deformation testing, such that the battery and helmet are suitable for various military applications. The mounting hardware between the battery, helmet, and any additional devices may be constructed of any suitable metal or material, as this aspect is not limited in this regard.

According to one aspect, the mounting hardware may be formed using any suitable process. The hardware may be stamped out of sheet metal, cast, injection molded, extruded, and so on. In addition, the battery and any additional devices may be encased in housings that are formed using any suitable process, such as injection molding, extrusion, casting, blow-molded, and so on. Any suitable finishing and/or processes may be applied to the hardware and/or housings.

The above aspects may be employed in any suitable combination, as the present invention is not limited in this respect. Additionally, any or all of the above aspects may be employed in a battery and helmet mounting arrangement; however, the present invention is not limited in this respect, as the above aspects may be employed with other mounting applications.

According to some embodiments of the invention, methods of attaching a battery pack to a helmet use the mounting arrangements disclosed herein. Methods of attaching devices to battery packs may use arrangements described herein. However, embodiments of the invention are not limited to use with batteries and helmets. According to some aspects, the mounting arrangement may be used to mount other objects/devices to helmets, body armor, or other surfaces.

Having thus described several aspects of at least one embodiment of this invention, it is to be appreciated that various alterations, modifications, and improvements will readily occur to those skilled in the art. For example, the battery and helmet mounting arrangement described herein may be adapted for use in other applications such as mounting to body armor or a backpack. Such alterations, modifications, and improvements are intended to be part of this disclosure, and are intended to be within the spirit and scope of the invention. Accordingly, the foregoing description and drawings are by way of example only.

What is claimed is:

1. A helmet system comprising: a helmet; a battery pack having at least one battery;

an attachment arrangement to removably attach the battery pack to the helmet, the attachment arrangement including a first engaging member on the battery pack, the first engaging member being coupleable to a second engaging member on the helmet;

a first electrical contact located on the battery pack, the first electrical contact configured to deliver power from the battery pack to a first device via an electrical contact on the helmet when the first device is attached to the helmet, wherein the first electrical contact delivers power from the battery pack to the first device only when the battery pack is attached to the helmet via the attachment arrangement, and wherein the first electrical contact cannot deliver power from the battery pack to the first device when the battery pack is completely removed from the helmet and the first engaging member on the battery pack is not coupled to the second engaging member on the helmet;

a mounting arrangement on the battery pack to removably mount a second device to the battery pack, the mounting arrangement including a third engaging member on the battery pack, the third engaging member being coupleable to a fourth engaging member on the second device, wherein the second device is physically supported by the battery pack when mounted to the battery pack via the mounting arrangement; and a second electrical contact located on the battery pack and spaced from the first electrical contact, the second electrical contact configured to deliver power from the battery pack to the second device by an electrical contact on the second device when the second device is mounted to the battery pack, wherein the second electrical contact can deliver electrical power from the battery pack to the second device without the battery pack being electrically connected to the first device, wherein the first device and the second device are simultaneously operable when the battery pack is attached to the helmet via the attachment arrangement.

2. The helmet system of claim 1, wherein:

the battery pack further comprises a first end portion;

the second electrical contact is located on the first end portion; and the mounting arrangement attaches the second device to the first end portion.

3. The helmet system of claim 2, wherein the first end portion is at the top of the battery pack.

4. The helmet system of claim 2, wherein the first end portion is at the bottom of the battery pack.

5. The helmet system of claim 1, wherein attachment of the battery pack to the helmet via the attachment arrangement electrically connects the battery pack to the first device.

6. The helmet system of claim 1, wherein the battery pack is curved along a vertical direction such that the battery pack conforms to a shape of the helmet.

7. The helmet system of claim 1, wherein attachment of the second device to the battery pack via the mounting arrangement electrically connects the battery pack to the second device.

8. The helmet system of claim 7, wherein the second electrical contact is configured to deliver power from the battery pack to the second device when the battery pack is detached from the helmet.

9. The helmet system of claim 1, wherein the first device is attached to the helmet.

10. A helmet system comprising: a helmet; a battery pack having at least battery;

a first attachment arrangement to removably attach the battery pack to the helmet, the first attachment arrangement comprising a locking member on the battery pack and an engaging member on the helmet to engage with the locking member; wherein the engaging member is configured to receive the locking member when the locking member is in a first configuration; when the locking member is engaged with the engaging member and in a second configuration, the locking member locks the battery pack to the helmet;

attachment of the battery pack to the helmet via the first attachment arrangement electrically connects the battery pack to an electrical contact on the helmet to deliver power to a first device;

detachment of the battery pack from the helmet via the first attachment arrangement electrically disconnects the battery pack from the electrical contact on the helmet, wherein the battery pack cannot deliver power to the electrical contact on the helmet when the battery pack is completely detached from the helmet;

the battery pack includes a device-engaging member to mount a second device to the battery pack; the battery pack is configured to deliver power from the battery pack to the second device when the second device is mounted to the battery pack and the battery pack is physically and electrically detached from the helmet; and the first device and the second device are simultaneously operable when the battery pack is attached to the helmet.

11. The helmet system of claim 10, further comprising a second attachment arrangement that cooperates with the first attachment arrangement to attach the battery pack to the helmet.

12. The helmet system of claim 11, wherein the first attachment arrangement restricts movement of the battery pack relative to the helmet in a first direction and the second attachment arrangement restricts movement of the battery pack relative to the helmet in a second direction, the second direction being different than the first direction.

13. The helmet system of claim 10, wherein the locking member is switchable between the first and second configurations by rotation of the locking member.

14. The helmet system of claim 10, wherein the locking member includes a hand-operable actuator to switch the locking member between the first and second configurations.

* * * * *